United States Patent [19]

Majer

[11] Patent Number: 4,747,277

[45] Date of Patent: May 31, 1988

[54] LATCH NEEDLE FOR A TEXTILE MACHINE

[75] Inventor: Sigmar Majer, Balingen, Fed. Rep. of Germany

[73] Assignee: Theodor Groz & Söhne & Ernst Beckert Nadelfabrik Commandit-Gesellschaft, Albstadt-Ebingen, Fed. Rep. of Germany

[21] Appl. No.: 881

[22] Filed: Jan. 6, 1987

[30] Foreign Application Priority Data

Jan. 11, 1986 [DE] Fed. Rep. of Germany ..... 3600620

[51] Int. Cl.[4] ..... D04B 35/04

[52] U.S. Cl. ..... 66/122

[58] Field of Search ..... 66/121, 122

[56] References Cited

U.S. PATENT DOCUMENTS

| | | | |
|---|---|---|---|
| 1,794,309 | 2/1931 | Marx | 66/122 X |
| 1,961,624 | 6/1934 | Schneider | 66/122 X |
| 3,459,009 | 8/1969 | Wiederhut et al. | 66/122 |
| 3,677,035 | 7/1972 | Wiederhut et al. | 66/122 |
| 3,850,011 | 6/1972 | Shepard et al. | 66/122 |
| 3,934,109 | 1/1976 | Shepard et al. | 163/5 X |

FOREIGN PATENT DOCUMENTS

| | | |
|---|---|---|
| 215749 | 11/1909 | Fed. Rep. of Germany . |
| 608619 | 1/1935 | Fed. Rep. of Germany . |
| 1296734 | 1/1970 | Fed. Rep. of Germany . |
| 1906892 | 5/1970 | Fed. Rep. of Germany . |
| 2330483 | 1/1974 | Fed. Rep. of Germany . |
| 836297 | 6/1960 | United Kingdom . |

*Primary Examiner*—Wm. Carter Reynolds
*Attorney, Agent, or Firm*—Spencer & Frank

[57] ABSTRACT

A latch needle for a textile machine including a latch displaceable in a longitudinal slot of a needle shank and pivotally mounted by means of a continuous bearing bore on two coaxial shaft stubs disposed at needle shank cheeks which laterally delimit the longitudinal slot. Each shaft stub projects into the longitudinal slot and comprises a separate cylindrical bolt which is inserted with a tight fit into a continuous bore in the associated needle shank cheek and is fixed therein so as to be secure against displacement.

10 Claims, 5 Drawing Sheets

Fig. 4
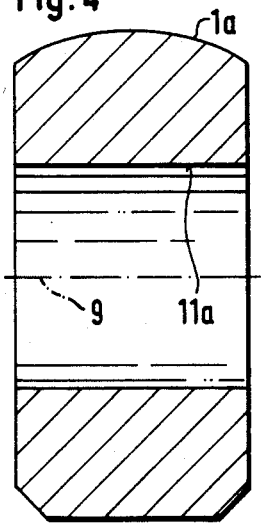
Fig. 5
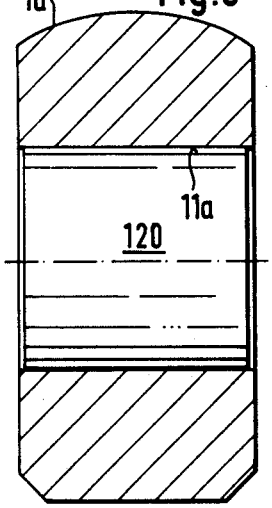
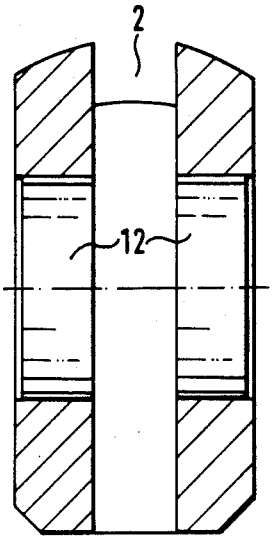
Fig. 6
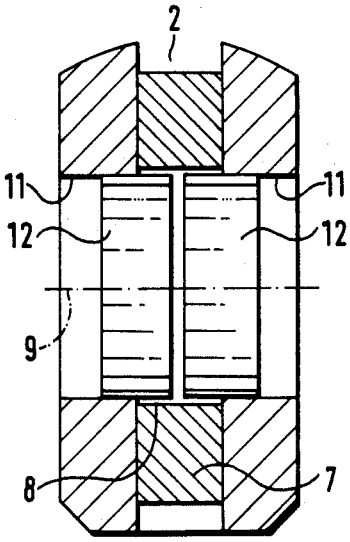
Fig. 7

LATCH NEEDLE FOR A TEXTILE MACHINE

BACKGROUND OF THE INVENTION

The present invention relates to a latch needle for a textile machine, including a latch which is pivotal in a longitudinal slot of a needle shank and which is pivotally mounted on two coaxial shaft stubs by means of a continuous bearing bore. The shaft stubs are disposed at needle shank cheeks which laterally delimit the longitudinal slot, with the shaft stubs projecting into the longitudinal slot. The invention also relates to a method of producing such a latch needle.

Latch needles of this type are widely used in various textile machines, particularly in knitting machines, and also, for example, in special sewing machines. Such latch needles in practice have two shaft stubs which project laterally into the longitudinal slot and which are formed by parts which are pressed out of two needle shank checks and deformed into the latch hole in the manner of bearing pins that are formed in one piece on the needle shank cheeks. Examples of latch needles with this type of latch bearing are disclosed, for example, in U.S. Pat. No. 3,934,109 and British Pat. No. 836,297.

Due to the fact that the two bearing pins have no firm connection with one another and contact one another in the latch bore at most with their frontal faces, the latch bearing has a certain amount of elasticity which has been found to be favorable with a view toward reducing the occurrence of breaks in the needle shank cheeks. It has been found in practice, however, that the material of the lateral cheeks displaced into the latch bore, due to its unpredictable flow behavior, is able to only incompletely adapt its shape to the shape of the latch bore so that in fact more or less great deviations result from the theoretical cylindrical shape of the shank stubs. It is a fact that even in a latch needle just received from the factory, the load per unit of surface area of the latch bore on the bearing pin which has been shaped through this bore at the needle shank cheeks in an embossing process is relatively small. With increasing periods of operation, a danger of needle malfunction arises from the fact that, as a result of the wear occurring on the latch bearing surface area the latch bearing play on the two bearing pins, whose shape only very imperfectly corresponds to a cylindrical shape, increases to such an extent that the free end of the latch, during the closing movement of the latch, misses the needle hook or slides off of it on the side, thus making the needle unusable.

U.S. Pat. No. 3,934,109, discloses a measure directed toward this problem which includes welding together, for example, by means of a highly focused laser beam, the frontal faces of the punched bearing pins which form the shaft stubs from material shaped from the shank cheeks. However, this measure has not overcome the problem. Such problem becomes more significant if the latch needles are used in fast moving knitting machines or are used to knit robust yarns, i.e. the latch bearing must meet very high demands, not only with respect to the accuracy of the latch guidance but also with respect to mechanical strength.

Other latch needles are known, for example, from German Pat. No. 1,296,734, in which the latch bearing is formed by a one-piece, cylindrical shaft pin or bolt which traverses the longitudinal slot of the needle shank and rests with both its ends in corresponding coaxial bores of the shank cheeks, it being either screwed to the shaft checks or rigidly connected therewith by means of laser welding. Although a latch needle, whose latch is mountd on such a separately manufactured, precisely cylindrical, continuous shaft bolt which is inserted into a corresponding transverse bore of the shank cheeks has excellent latch guidance with respect to accuracy and wear resistance due to the precisely worked cylindrical jacket faces of the smooth shaft bolt, such latch needles are today almost without significance because the latch bearing arrangement employing a continuous shaft bolt is rigid and is completely inelastic transversely to the axis of symmetry of the needle. This inevitably causes a break in the needle shank checks when the needle is subjected to high, and particularly to dynamic, stresses, thus limiting the service life of such needles in an undesirable manner.

Additionally, it is known from German Pat. No. 215,749 to mount the shaft bolt on one side in a blind bore of the associated needle shank cheek and to secure it by welding on the other side in the transverse bore of the corresponding needle shank cheek. Although this does provide for a certain amount of elasticity in the latch bearing, such elasticity is limited, aside from the fact that the manufacture of such needles is expensive so that they are not suitable for mass production.

SUMMARY OF THE INVENTION

It is therefore an object of the present invention to provide a latch needle which can be economically mass produced and which is distinguished by a low wear bearing and a tight bearing play for the latch so that it retains its full utility over long periods of operation and, simultaneously, the danger of the occurrence of breaks of the needle shank cheeks is eliminated or reduced to a minimum.

To accomplish the above and other objects, there is provided, according to the invention, a latch needle in which each shaft stub has the shape of a separate cylindrical bolt and is inserted with a tight fit through a continuous bore in the associated shank cheek, and is fixed in this bore so as to be secure against displacement.

Due to the jacket faces of the two shaft stubs being smooth and precisely cylindrical and in cooperation with a latch shaft which is precisely matched to the width of the longitudinal slot, there results the greatest possible load per unit of surface area between the bearing shaft and the latch bore, thus correspondingly minimizing the specific pivot bearing load per unit of surface area which results in increased wear resistance of the latch bearing. Since the latch bore diameter can be made to approach that of the shank stubs, whose diameter does not change, to a diameter difference of, for example, +0.001 mm or less, it is possible to attain very tight latch bearing play in the axial as well as radial direction. Thus, the latch is guided with great precision and, even after long periods of operation, its pivoting movement will not deviate noticeably from the axis of symmetry of the needle and the latch places itself reliably onto the hook during the closing process. Since the two shaft stubs are not connected to one another at their adjacent frontal faces, the latch bearing simultaneously has so much elasticity transversely to the axis of symmetry of the needle that breaks in the cheeks are permanently prevented. The axial spacing between the adjacent frontal faces of the shaft stubs in the latch bore should be at least about 0.01 mm. However, experiments have shown that for needless less than a certain thickness, sufficient elasticity of the latch bearing is also given if the two shaft stubs are arranged to abut one another at their adjacent frontal faces.

Advisably, the two shaft stubs are fixed in the bore in the region of their frontal faces which face away from the longitudinal slot and which may, for this purpose, for example, be welded to the shank cheeks, particularly by means of laser welding. It has been found to be of particular advantage, however, for the shaft stubs to be fixed by means of deformation of the material of the respective shank cheek surrounding the bore, with such deformations projecting into the bore. Such deformations may be manufactured by a conventional embossing process, such as coining with a pin on a stamping die.

The arrangement may here be such that the shaft stubs are mounted only in the region of the shank cheek bores adjacent the longitudinal slot and extend to about half of the length of the bore, so that the remaining free portion of the bore is available for fixing the shaft stubs. In a preferred embodiment of the invention, an annular bead of material is provided in the vicinity of the end of each shaft stub facing away from the longitudinal slot. This annular bead is shaped of the material of the shank cheek surrounding the bore and extends into the free part of the bore. The bead may be disposed at a distance from the adjacent outer frontal face of the associated shaft stub so that it merely prevents the shaft stubs from wandering out of the bore under the influence of the latch movement, but in any case the bead reliably poses no interference with the elasticity of the latch bearing.

Such a latch needle can be manufactured according to the invention in a particularly simple, economical and precise manner in that, starting out with an unslotted needle shank, a transverse bore is initially made in the needle shank, which bore is coaxial with the pivot axis of the latch, a continuous cylindrical bolt is then inserted into the transverse bore with a tight fit, and then the longitudinal slot is worked in the needle shank by severing the bolt. After the subsequent insertion of the latch into the longitudinal slot, the portions of the bolt remaining in the two needle shank cheeks which laterally delimit the longitudinal slot are inserted, as shaft stubs, into both sides of the bearing bore of the latch and are finally fixed in the bore of the shank checks to be secure against displacement.

The bolt inserted into the transverse bore may project beyond the needle shank on both sides by a length corresponding at most to one-half the width of the later formed longitudinal slot. After insertion of the bolt members into the bearing bore, the bolt members are essentially flush with the outer sides of the needle shank. The two bolt members may also have such a length, and be inserted by means of pressing tools which engage into the bores of the shank checks so that, in the inserted state, the outer frontal faces of the bolt members lie within the respective shank check bore. To fix the bolt members, the material of the shank cheeks surrounding the bore in the shank cheeks may then be plastically deformed and, in a preferred embodiment of the invention, the material of the shank cheeks is deformed into an annular bead which projects into the respective bore, possibly at an axial distance from the adjacent outer frontal face of the associated bolt member.

BRIEF DESCRIPTION OF THE DRAWINGS

Embodiments of the invention are illustrated in the drawings, wherein:

FIGS. 4 to 7 are enlarged sectional views along line A–B of FIG. 1 illustrating four successive states during manufacture.

DESCRIPTION OF THE PREFERRED EMBODIMENTS

Figure 1:
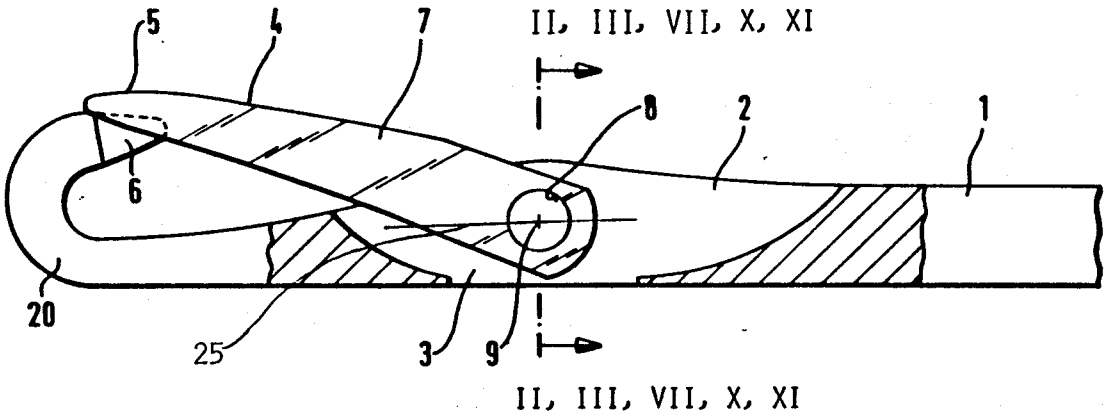
FIG. 1 is a longitudinal view, in partial cross-section, of a latch needle according to the invention.

The latch needle shown in FIG. 1 includes a needle shank 1 which has a hook 20 shaped at its one end and may have at least one foot (not shown in detail) with which the needle is controlled by means of known lock members of, for example, a knitting machine. A longitudinal slot 2, symmetrical with the longitudinal axises of the needle, is cut into needle shank 1 and opens over a passage 3 in the lower edge of the needle shank to discharge lint toward the lower edge of the needle. A needle latch 4, comprised of a latch shank 7, is pivotally accommodated in slot 2. In the illustrated closed position, a blunt end 5 of needle latch 4 covers a tip 6 of the needle. In the vicinity of its end facing away from latch tip 5, needle latch 4 is provided with a continuous, cylindrical bearing bore 8 in which latch 4 is pivotally mounted. The transversely extending pivot axis is indicated at 9.

Figure 2:
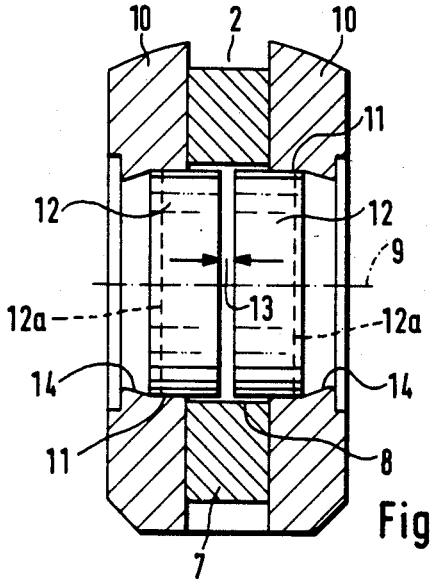
FIG. 2 is an enlarged sectional side view along line A–B of FIG. 1.
Figure 3:
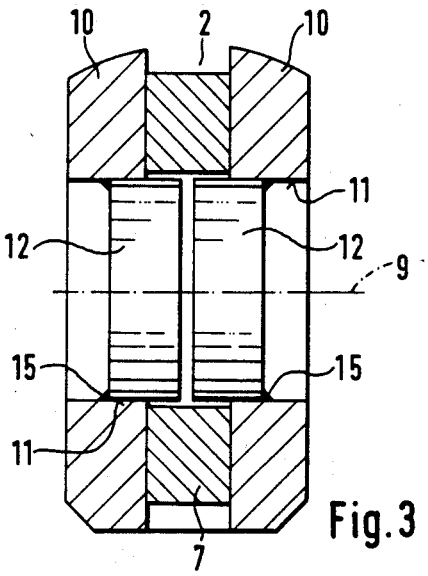
FIG. 3 is an enlarged sectional view of a modified embodiment of the components shown in FIG. 2.

As shown, in particular in FIGS. 2 and 3, each one of the needle shank cheeks 10, which laterally delimit longitudinal slot 2, is provided with a cylindrical bore 11 which is coaxial with pivot axis 9. A shaft stub 12, in the form of a separate cylindrical bolt, is inserted into each bore 11 with a tight, press fit so that it projects into longitudinal slot 2 and engages into bearing bore 8 of latch shank 7. The two coaxial cylindrical shaft stubs 12 are axially spaced from one another at their facing parallel frontal faces to form a gap 13 of at least 0.01 mm.

On the smooth jacket faces of the two coaxial cylindrical shaft stubs 12, the bearing bore 8 of latch shank 7 is mounted with little play, there being a diameter difference of +0.001 mm or less between shaft stubs 12 and bearing bore 8. Latch shank 7 is guided with precision and with little play between the parallel faces of needle shank cheeks 10 which define longitudinal slot 2.

The two cylindrical shaft stubs 12 are fixed in their respective bore 11 of the associated needle shank cheek 10 so as to be secure against displacement.

In the embodiment of FIG. 2, shaft stubs 12 are mounted only in the regions of bores 11 of needle shank cheeks 10 which extend from slot 2 outwardly to about one-half the length of the bore. Deformations, indicated at 14, are made in the material of each needle shank cheek 10 where it surrounds bore 11 and these deformations preferably have the shape of an annular bead so as to prevent axial displacement of shaft stubs 12 toward the exterior of shank cheeks 10. Instead of an annular bead, individual finger or tooth like embossments which project into bore 11, or corresponding deformations of the material of the shank cheeks, may also be provided as fixing means.

The annular bead at 14, or the corresponding embossments or deformations, may be disposed, as shown in FIG. 2, directly at the adjacent outer frontal face of the respectively adjacent shaft stub 12. However, the arrangement may advantageously also be such that an axial distance exists between each bead 14 and the adjacent outer frontal face which then extends to the dashed lines 12*a* in FIG. 2.

The embodiment according to FIG. 3 essentially corresponds to that of FIG. 2. Therefore identical parts have been given the same reference numerals and will not be described again. In contrast to the embodiment according to FIG. 2, the two coaxial, cylindrical shaft stubs 12 are here fixed in the associated bore by welding, preferably by means of a laser beam. The weld seam or weld location is marked with the numeral 15.

Figure 8:
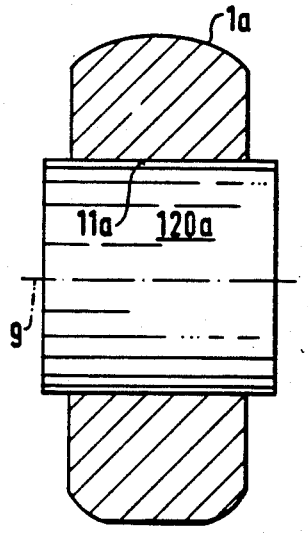
FIGS. 8 to 10 are enlarged sectional views along line A–B of FIG. 1 to illustrate three successive states during an alternate manufacturing process.
Figure 9:
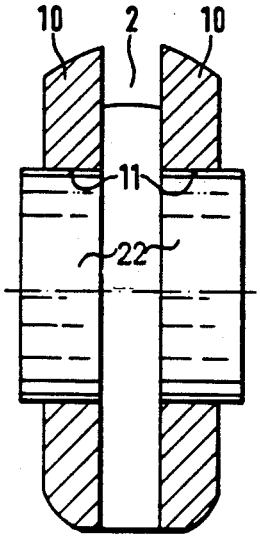
Figure 10:
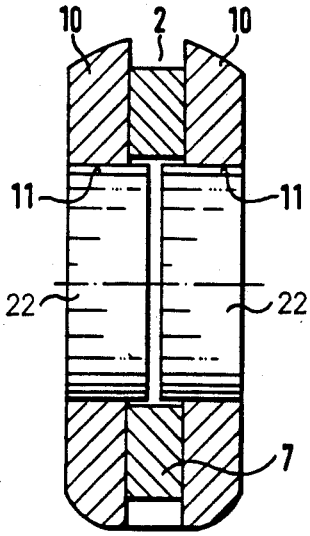

The latch needle according to FIG. 1, insofar as the latch bearing is concerned, can be manufactured in a particularly simple and precise manner as illustrated in FIGS. 4 to 7, or, in the slightly modified manner illustrated in FIGS. 8 to 10.

Starting with a needle blank having a needle shank 1 which does not yet have a slot, as shown in FIGS. 4 and 8, a cylindrical bore 11*a*, which is coaxial with the pivot axis 9 of the latch, is initially produced in needle shank 1*a*, for example, by punching. The diameter of bore 11*a* corresponds to the diameter of the two later produced shaft stubs 12. A cylindrical bolt 120 (FIG. 5) or 120*a* (FIG. 8) is then pressed with a tight fit into the continuous transverse bore 11*a*, with the length of the bolt in FIG. 5 corresponding to the thickness of needle shank 1*a* and in FIG. 8 approximately to 1.25 times the thickness of shank 1*a*. Accordingly, in FIG. 5, the inserted bolt 120 is flush with the side faces of needle shank 1*a*, while bolt 120*a* in FIG. 8 projects beyond the side faces of needle shank 1a by a corresponding amount which, however, corresponds at most to one-half the width of the later formed longitudinal slot 2.

Then, according to FIGS. 6 and 9, the longitudinal slot is cut in the needle shank, while simultaneously cutting through bolts 120 and 120*a* to thus subdivide the bolts into the two shaft stubs 12 (FIG. 6) and stubs 22 (FIG. 9).

Figure 11:
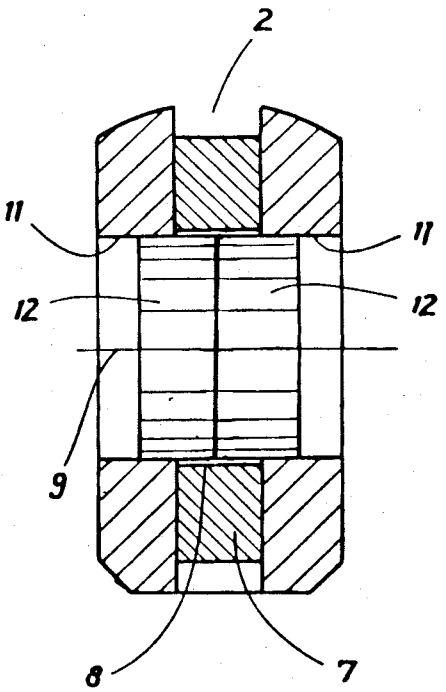
FIG. 11 is an enlarged sectional view of a modified embodiment of the components shown in FIG. 2.

Latch shank 7 of needle latch 4 is then inserted into longitudinal slot 2 so that its bearing bore 8 is coaxial with pivot axis 9, whereupon the two bolt members forming the two shaft stubs 12 (FIG. 6) or stubs 22 (FIG. 9) are advanced axially from both sides toward the plane of symmetry of the needle, thus entering into bearing bore 8 of latch shank 7. In the inserted state, the two shaft stubs 12 (FIG. 6) or stubs 22 (FIG. 9) may either be spaced slightly from one another by a gap 13 (FIG. 2) as already mentioned, or, alternatively, may also lie against one another at their frontal faces as shown in FIG. 11.

While in the embodiment according to FIGS. 8 to 10, the outwardly oriented frontal faces of the two shaft stubs 22, in the inserted state, are flush with the side faces of the needle shank (FIG. 10), in the embodiment according to FIGS. 4 to 7, the shaft stubs 12 are inserted by means of a pressing tool (not shown) which engages in bores 11 such that the outwardly oriented frontal faces of the two shaft stubs 12 are mounted in the respective bores 11, extending a distance therein corresponding approximately to one-half the width of longitudinal slot 2.

Finally, the two inserted shaft stubs 12 or 22 are fixed, either by means of the embossed annular bead 14 or by welding at 15 in the manner shown in FIGS. 2 and 3, so as to be secure against displacement in bores 11 of the lateral needle cheeks 10 which are separated from one another by longitudinal slot 2.

The present disclosure relates to the subject matter disclosed in German Pat. No. P 36 00 620.3 of Jan. 11, 1986, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A latch needle for a textile machine, comprising:

a needle shank having a longitudinal slot and needle shank cheeks on either side of, and delimiting, said slot, each cheek having a continuous bore therein which is coaxial with a pivot axis transverse to a longitudinal axis of said needle shank;

a latch having a bearing bore, said latch being disposed in said slot with said bearing bore coaxially aligned with said pivot axis;

two shaft stubs each comprised of a separate cylindrical bolt, each shaft stub being disposed with a tight, press fit in a respective one of the continuous bores of said needle shank cheeks so as to be coaxial with said pivot axis and extending into the bearing bore of said latch, said latch being displaceable in said slot and pivotally mounted by said two shaft stubs extending into said bearing bore; and fixing means for fixing each shaft stub against axial displacement out of the continuous bore of the respective needle shank cheek.

2. Latch needle as defined in claim 1, wherein each of said two shaft stubs has frontal faces at opposite ends thereof and said two shaft stubs are arranged to abut one another at their adjacent frontal faces.

3. Latch needle as defined in claim 1, wherein each of said two shaft stubs has frontal faces at opposite ends thereof and said two shaft stubs are arranged in said continuous bores to define a gap of at least 0.01 mm between their adjacent frontal faces.

4. Latch needle as defined in claim 1, wherein each shaft stub has frontal faces at opposite ends thereof and said two shaft stubs are each fixed in a respective one of said continuous bores in the region of their frontal faces which face away from said longitudinal slot.

5. Latch needle as defined in claim 4, wherein said fixing means comprises a weld joining each shaft stub to a respective one of said needle shank cheeks.

6. Latch needle as defined in claim 5, wherein said weld is formed by laser welding.

7. Latch needle as defined in claim 4, wherein said fixing means comprise deformed portions of a respective one of said needle shank cheeks in a region surrounding the respective continuous bore, with said each said deformed portion projecting into the respective one of said continuous bores.

8. Latch needle as defined in claim 1, wherein said two shaft stubs are mounted only in a region of said continuous bores adjacent said longitudinal slot, with said regions extending to approximately one-half the length of the respective continuous bore.

9. Latch needle as defined in claims 7, wherein said fixing means comprise an annular bead formed of material of the respective needle shank cheek surrounding the respective continuous bore in the vicinity of an end of each shaft stub facing away from said longitudinal slot, said bead projecting into the region of said continuous bore not occupied by a said shaft stub.

10. Latch needle as defined in claim 9, wherein said bead of material is disposed at a distance from the end of the respective shaft stub facing away from said longitudinal slot.

* * * * *